US005806244A

United States Patent [19]

Tilli

[11] Patent Number: 5,806,244

[45] Date of Patent: Sep. 15, 1998

[54] SINGLE DRIVE DUAL RACK AND PINION WINDOW REGULATOR

[75] Inventor: Christopher R. Tilli, Westland, Mich.

[73] Assignee: UT Automotive Dearborn, Inc., Dearborn, Mich.

[21] Appl. No.: 866,640

[22] Filed: May 30, 1997

[51] Int. Cl.[6] ..... E05F 11/00

[52] U.S. Cl. ..... 49/358; 49/349; 49/362

[58] Field of Search ..... 49/348, 349, 358, 49/350, 324, 362

[56] References Cited

U.S. PATENT DOCUMENTS

| | | | |
|---|---|---|---|
| 1,683,914 | 9/1928 | Pfiffer | 49/362 X |
| 1,850,091 | 3/1932 | Bailey | 49/362 |
| 1,937,662 | 12/1933 | Nicholson | 49/362 X |
| 2,115,632 | 4/1938 | Hanley | 49/348 X |
| 2,336,530 | 12/1943 | Chandler et al. | 49/349 |
| 2,883,780 | 4/1959 | Goodman | 49/348 X |
| 4,119,341 | 10/1978 | Cook | 49/348 X |
| 4,235,117 | 11/1980 | Pickles | 49/349 X |
| 4,698,938 | 10/1987 | Huber | 49/362 X |

*Primary Examiner*—Jerry Redman
*Attorney, Agent, or Firm*—Howard & Howard

[57] ABSTRACT

A window regulator system generally comprises a first pinion rotatably driven by a motor. The first pinion is mounted between a first rack and a rotatable second pinion. The second pinion is rotatably mounted between the first pinion and a second rack. Teeth on the first pinion engage the first rack and simultaneously drive the second pinion to engage the second rack.

15 Claims, 1 Drawing Sheet

SINGLE DRIVE DUAL RACK AND PINION WINDOW REGULATOR

BACKGROUND OF THE INVENTION

The present invention relates generally to a window regulator system and more particularly to a single drive dual rack and pinion window regulator system.

A dual rack and pinion window regulator system having a single motor providing a dual drive has been proposed. The motor is mounted on a mounting plate and drives a series of gears. The dual drive is provided by two output shafts extending from two of the gears. The two output shafts are each fixed to a pinion. The two driven pinions are laterally spaced and each engage a separate rack. Operation of the motor turns the plurality of gears and the output shafts, thereby causing each of the pinion gears to engage the corresponding rack, raising and lowering the mounting plate, pinions, and motor. The additional gearing of this proposed system increases the cost, number of parts and weight of the window regulator system.

Another proposed rack and pinion window regulator system provides a single drive, and a single rack and pinion. In that system, a rack and a parallel, laterally spaced guide bar are positioned adjacent the mounting plate supporting the window glass and a motor. The motor drives a pinion which engages the rack. A guide arm extending from the mounting plate to the guide bar slides along the guide bar to provide stability. This system does not operate as smoothly as desired, since the upward and downward force is exerted on a single point on the mounting bracket.

SUMMARY OF THE INVENTION

The present invention provides a single drive, dual rack and pinion window regulator system. A motor drives a first pinion having a plurality of circumferentially spaced teeth engaging teeth on a first rack. The teeth on the first pinion also engage teeth on a second pinion mounted between the first pinion and a second rack.

The motor includes a shaft upon which the first pinion is fixedly mounted. The motor is preferably mounted on a mounting plate upon which the window is supported. The second pinion is rotatably mounted on the mounting plate adjacent the first pinion. Operation of the motor causes the mounting plate, together with the motor and pinions, to raise and lower relative to the racks.

The single drive provides simplified operation and a reduced number of parts. Further, the dual rack and pinion exerts upward and downward force on two points on the mounting plate, thereby providing stability and smooth operation.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
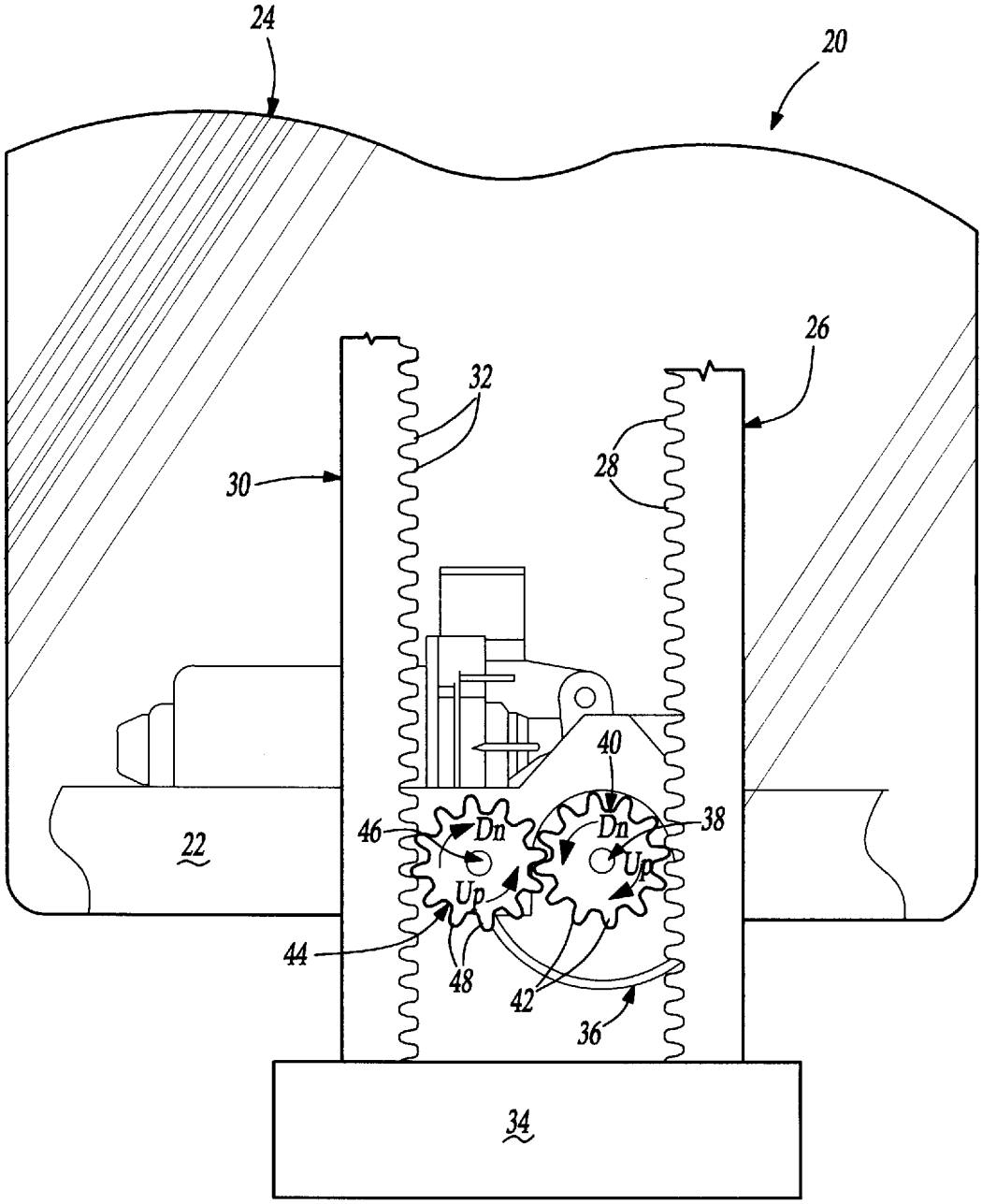
FIG. 1 illustrates the window regulator system of the present invention.

A window regulator system 20 for raising and lowering a mounting plate 22 supporting a window glass 24 is shown in FIG. 1. A first rack 26 having laterally extending teeth 28 is laterally spaced from a parallel second rack 30 having laterally extending teeth 32. The first and second racks 26, 30 are oriented so that the teeth 28, 32 extend toward each other. The first rack 26 and second rack 30 extend upwardly adjacent the mounting plate 22 and are both fixed to an object 34, such as the door of a vehicle.

A motor 36 is mounted to the mounting plate 22 and rotatably drives a shaft 38. A first pinion 40 is fixedly mounted on the shaft 38 of the motor 36 and includes a plurality of circumferentially spaced teeth 42 engaging the teeth 28 of the first rack 26. A second pinion 44 is rotatably mounted on a shaft 46 extending from the mounting plate 22 adjacent the first pinion 40. The second pinion 44 includes a plurality of circumferentially spaced teeth 48 engaging the teeth 42 of the first pinion 40 and the teeth 32 of the second rack 30.

In operation, the motor 36 is selectively operated in a known manner, i.e. by user activated switches (not shown), causing the shaft 38 to rotate in either direction. The rotation of the shaft 38 causes rotation of the first pinion 40 which engages the rack 26 to impart a force on the mounting plate 22 upward or downward, as appropriate. Simultaneously, the first pinion 40 engages the second pinion 44, causing the second pinion 44 to rotate in an opposite direction. Because the first and second pinions 40, 44 are between the first and second racks 26, 30, rotation of the first and second pinions 40, 44 in opposite directions imparts a force on the mounting plate 22 in the same direction. As a result, two racks and pinions are operated with only one of the pinions requiring a motor drive. The window regulator system 20 provides a simplified gearing and motor assembly, while imparting a force upward or downward on the mounting plate 22 at two laterally spaced points, i.e. the shafts 46 and 38.

In accordance with the provisions of the patent statutes, the present invention has been described in what is considered to represent a preferred embodiment. However, it should be noted that the invention can be practiced otherwise than as specifically illustrated and described without departing from its spirit or scope.

What is claimed is:

1. A window regulator system comprising:

a motor having a shaft;

a first pinion rotatably driven by said motor, said first pinion engaging a first rack;

a second pinion rotatably driven by said first pinion, said second pinion engaging a second rack, whereby rotation of said motor causes vertical movement of said motor, said first pinion and said second pinion relative to said first rack and said second rack.

2. The window regulator system of claim 1 wherein said second pinion is rotatably supported adjacent said first pinion and in engagement with said first pinion.

3. The window regulator system of claim 1 wherein said first and second pinions are mounted on a mounting plate, rotation of said first and second pinions causing movement of said mounting plate relative to said first and second racks.

4. The window regulator system of claim 3 further including a window supported by said mounting plate.

5. The window regulator system of claim 1 wherein said first pinion engages said second pinion.

6. The window regulator system of claim 5 wherein said first pinion includes a plurality of circumferentially spaced teeth engaging a plurality of circumferentially spaced teeth on said second pinion.

7. The window regulator system of claim 1 wherein said first pinion is non-rotatably mounted on said shaft of said motor.

8. The window regulator system of claim 1 wherein said first and second pinions each include a plurality of circumferentially-spaced teeth, said teeth of said first pinion engaging said first rack, said teeth of second pinion engaging said second rack, said second pinion rotatably driven via said teeth of said first pinion and said teeth of said second pinion.

9. The window regulator system of claim 1 wherein said first pinion rotates on a first axis and said second pinion rotates on a second axis parallel to said first axis, said first and second pinions simultaneously rotating in opposite rotational directions about their respective axes.

10. The window regulator system of claim 1 wherein said first and second pinions are both mounted between said first and second racks.

11. A window regulator system comprising:

a mounting plate;

a motor having a shaft and mounted on said mounting plate;

a first rack;

a second rack laterally spaced from said first rack;

a first pinion between said first rack and said second rack, said first pinion non-rotatably mounted on said shaft of said motor, said first pinion engaging said first rack;

a second pinion between said first pinion and said second rack, said second pinion rotatably supported on said mounting plate and rotatably driven by said first pinion, said second pinion engaging said second rack;

whereby rotation of said motor causes vertical movement of said motor, said first pinion and said second pinion relative to said first rack and said second rack.

12. The window regulator system of claim 11 further including a window supported by said mounting plate.

13. The window regulator system of claim 11 wherein said first pinion engages said second pinion.

14. The window regulator system of claim 13 wherein said first and second pinions include circumferentially-spaced teeth, said teeth of said first pinion engaging said teeth of said second pinion.

15. A window regulator system comprising:

a mounting plate;

a window supported by said mounting plate;

a motor having a shaft and mounted on said mounting plate;

a first rack having a plurality of laterally-extending teeth;

a second rack laterally spaced from said first rack, said second rack including a plurality of teeth extending toward said first rack, said teeth of said first rack extending toward said second rack;

a first pinion between said first rack and said second rack, said first pinion rotatably driven by said motor, said first pinion having a plurality of circumferentially spaced teeth engaging said teeth on said first rack;

a second pinion between said first rack and said second rack, said second pinion rotatably supported adjacent said first pinion, said second pinion having a plurality of circumferentially spaced teeth engaging said teeth on said second rack, said teeth on said second pinion in engagement with said teeth on said first pinion, whereby rotation of said motor causes movement of said motor and said first and second pinions relative to said first rack and said second rack.

* * * * *

UNITED STATES PATENT AND TRADEMARK OFFICE

Certificate

Patent No. 5,806,244 Patented: September 15, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Christopher R. Tilli, Westland, MI; and Paul J. Fenelon, Nashville, TN.

Signed and Sealed this Fifteenth Day of June, 1999.

DANIEL P. STODOLA
*Supervisory Patent Examiner*
Art Unit 3634